United States Patent [19]

Engwall et al.

[11] 4,303,225

[45] Dec. 1, 1981

[54] SELF-TAILING WINCH

[75] Inventors: Sten Engwall, Charlottenbergs gård, Märsta, Sweden, 195 00; Clifford K. Fitch, London, England

[73] Assignee: Sten Engwall, Märsta, Sweden

[21] Appl. No.: 73,642

[22] Filed: Sep. 10, 1979

[30] Foreign Application Priority Data

Sep. 15, 1978 [SE] Sweden ..... 7809763

[51] Int. Cl.[3] ..... B66D 1/30

[52] U.S. Cl. ..... 254/344; 254/371

[58] Field of Search ..... 254/333, 278, 344, 345, 254/352, 371, 374

[56] References Cited

U.S. PATENT DOCUMENTS

| | | | |
|---|---|---|---|
| 46,110 | 1/1865 | Jackson et al. | 254/371 X |
| 1,928,117 | 9/1933 | Stewart | 254/371 X |
| 1,984,604 | 12/1934 | Stahl | 254/278 |
| 3,841,606 | 10/1974 | Declercq | 254/333 |
| 4,120,486 | 10/1978 | Mehnert | 254/371 |
| 4,225,118 | 9/1980 | Ottemann | 254/333 |

*Primary Examiner*—Philip R. Coe

*Attorney, Agent, or Firm*—Holman & Stern

[57] ABSTRACT

Known winches for sailing boats have flanges which are perpendicular to the axis of rotation. The instant invention comprises a self-tailing winch in which the upper flange is inclined in relation to the axis of rotation and follows the rotation of the drum. In operation, the rope rises along the drum as it is taken up by the winch. When the rope has reached the underside of the flange, it is automatically clamped, and, since the flange is inclined, the rope will become loose during rotation of the flange as the drum lets out the rope.

7 Claims, 3 Drawing Figures

1
33
30
6
14
11
3
2
10
α
9
21
32
11
30
33
28

SELF-TAILING WINCH

BACKGROUND OF THE INVENTION

Field of the Invention

This invention relates to a winch consisting of a rotatable drum, on which a rope can be wound a number of turns and runs out from the last turn, whereby the rope is pulled in by rotating the drum, said drum being widened at least in one end, so that one, at least partly annular surface is formed.

SUMMARY OF THE INVENTION

The object of the invention is to form a winch so that it is self-tailing, which means that the free part of the rope, which is leaving the drum will be fixed in relation to the drum, whereby the rope can be wound without manually holding the free end of the rope as is common with ordinary winches.

DESCRIPTION OF THE PRIOR ART

Winches of above described construction are known as self-tailing winches and the known winches include separate mechanical means arranged on the upper surface of the drum, and consists of a groove, which clamps the leaving part of the rope. These known means will, however, raise the production costs of the winches very much and moreover the rope will be worn out by the groove. The invention according to this application includes a clamping means which is simple both in construction and use and will not wear out a rope.

BRIEF DESCRIPTION OF THE DRAWINGS.

In the drawings.

The right part of FIG. 1 is a side view of a winch according to the invention and left part is a section along the axis of the winch.

DESCRIPTION OF THE PREFERRED EMBODIMENTS

Figure 1:
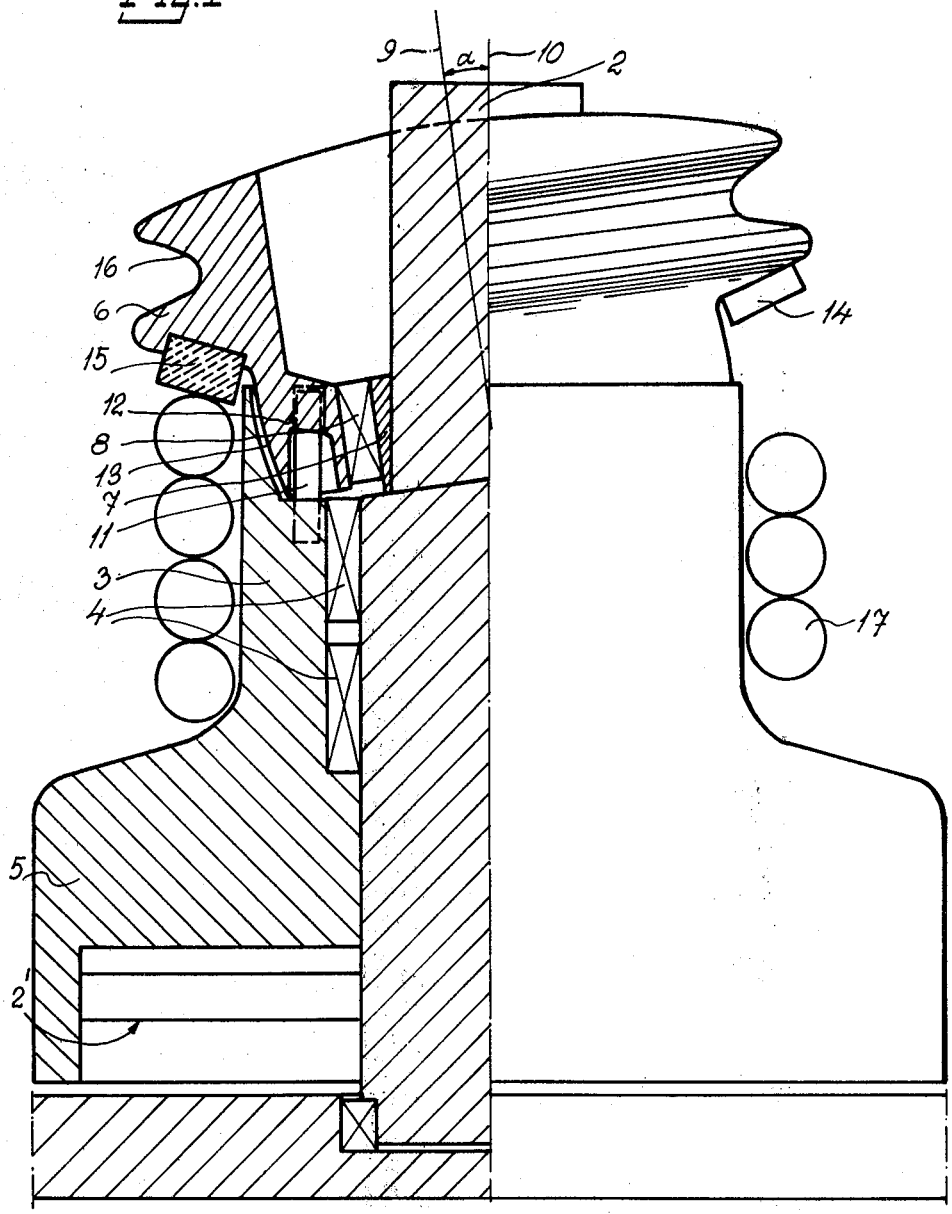
Figure 2:
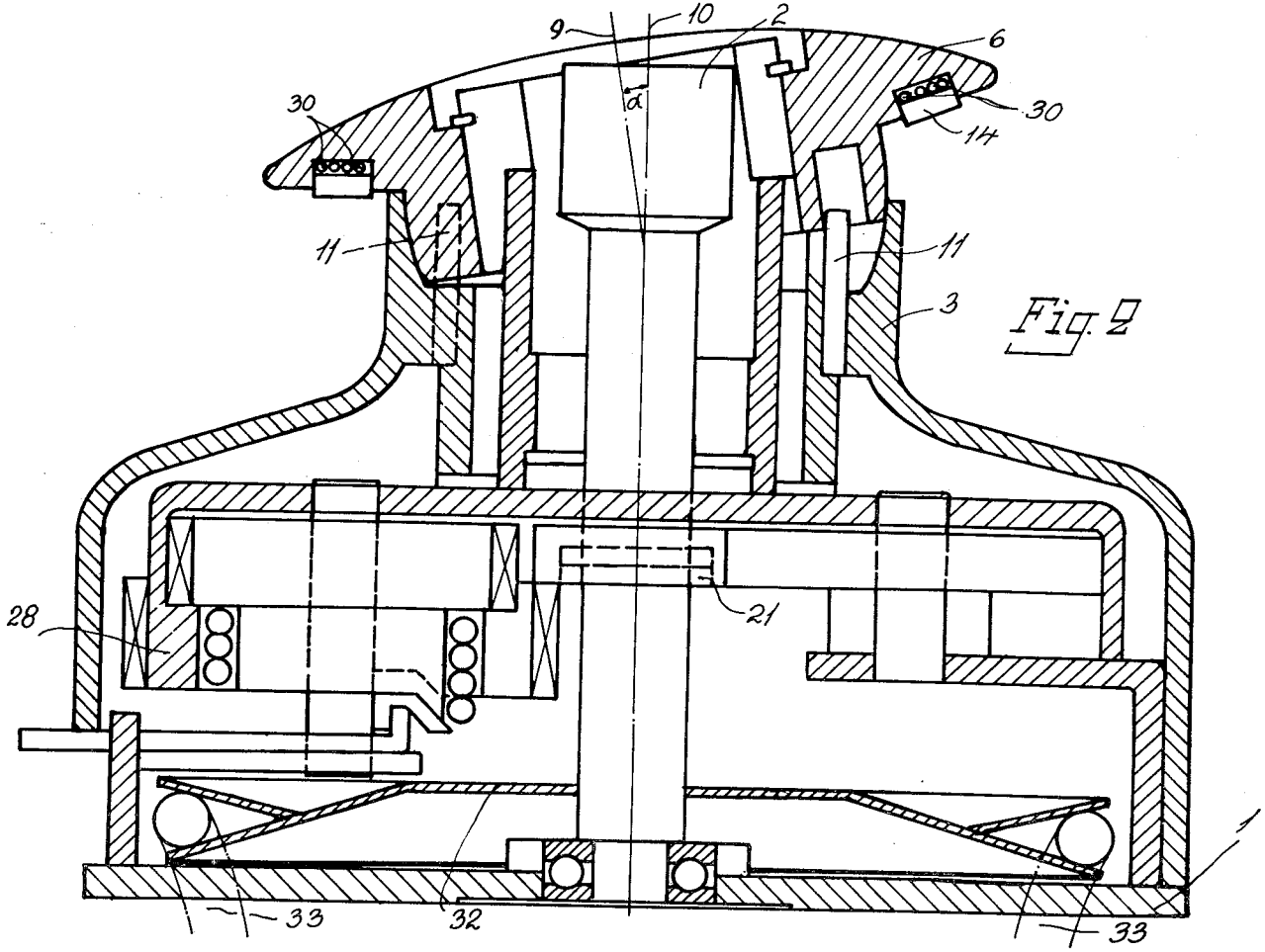
FIG. 2 is a view of a second embodiment of the invention.

The self-tailing winch shown in FIGS. 1 and 2 includes a base 1 on which an axle or shaft 2 is rotatably mounted. The way of mounting the shaft on the base is schematically shown and is known per se and does not form a part of the invention. A drum 3 is rotatably supported by shaft 2 by means of bearings 4, see FIG. 1. The drum 3 is rotated by the shaft 2 and this is achieved by a gear 2' placed between the shaft 2 and the drum 3. This gear may be of known construction and may incorporate a reverse operation but since the gear box does not form a part of the invention it is only shown schematically. From FIG. 1 it can be seen that the drum of the winch has a flange 5, which surrounds the gear box 2'.

At the upper end of the drum there is a flange body 6, which is freely rotatably supported by the shaft 2 and is free from the drum 3 to rotate. The flange body 6 is supported inclined in relation to the shaft 2 by means of a bushing 7 having an inclined inner surface and by means of a bearing 8. The dotted line 9 denotes the geometrical rotating axis of the flange body 6, and the line 10 denotes the geometrical rotation axis 2 of the drum 3. The two rotational axes form an angle $\alpha$ which can be seen from FIGS. 1 and 2. This angle is preferably about 8°.

The upper end of the drum 3 has several pins 11, which project into holes 12 which are drilled from the under face of the flange body 6. These pins 11 are follower pins between the drum 3 and the flange body 6. During the rotation, the pins will move into and out of the holes 12 in relation to the degree of inclination between the flange body 6 and the upper end of the winch drum 3. In FIG. 1 only one pin 11 is shown, but there are arranged a number of pins, for instance six.

As can be seen from FIG. 1, the flange body 6 is projecting downwards a certain distance into the winch drum 3. Bearing surfaces may be arranged at 13 in the form of self-lubricating or dry bearing surfaces in order to support the flange body 6 in the winch drum 3.

On the under surface of the flange body 6 there is an annular surface 14 and this surface can be formed of rubber or a corresponding material. In the shown embodiment the annular surface is formed from a ring 15 fixed to the under surface of the flange body 6.

The flange body 6 may have peripheral groove 16, which may be wedge-shaped in section and is adapted to the diameter of the rope. The paid out part of the rope may be inserted into the groove 16, whereby it is fixed in a secure position.

The operation of the winch is such, that the flange body 6 is inclined in a fixed position in relation to the rotational shaft 2 of the winch drum and follows the rotation of the winch drum. When the rope 17 is wound a certain amount of turns around the drum 3, the rope will rise around the outer surface of the drum when the rope is paid in by the drum 3. The rope 17 will reach the under surface of the flange body 6 and thereby abut the annular surface 14 where this has its lowest point. This position is shown in the left part of FIG. 1. The rope will automatically be clamped, because of the inclination of the annular surface 14 in relation to the rotating shaft 2. During the rotation of the drum 3, the rope will automatically be loosened from the clamping action of the annular surface because of the simultaneous rotation of the winch drum 3 and the flange body 6. It should be noted that the clamping action occurs only where the annular surface 14 is passing its lowest point. Tests have shown that the rope is so well fixed around the winch drum 3 by the clamping action of the annular surface 14 that no further means are necessary in clamping the rope when the winch is operated or when the rope has been paid in as much as is wished. Also it is possible to pay out the incoming part of the rope without doing anything but reversing the rotation movement of the drum.

Figure 3:
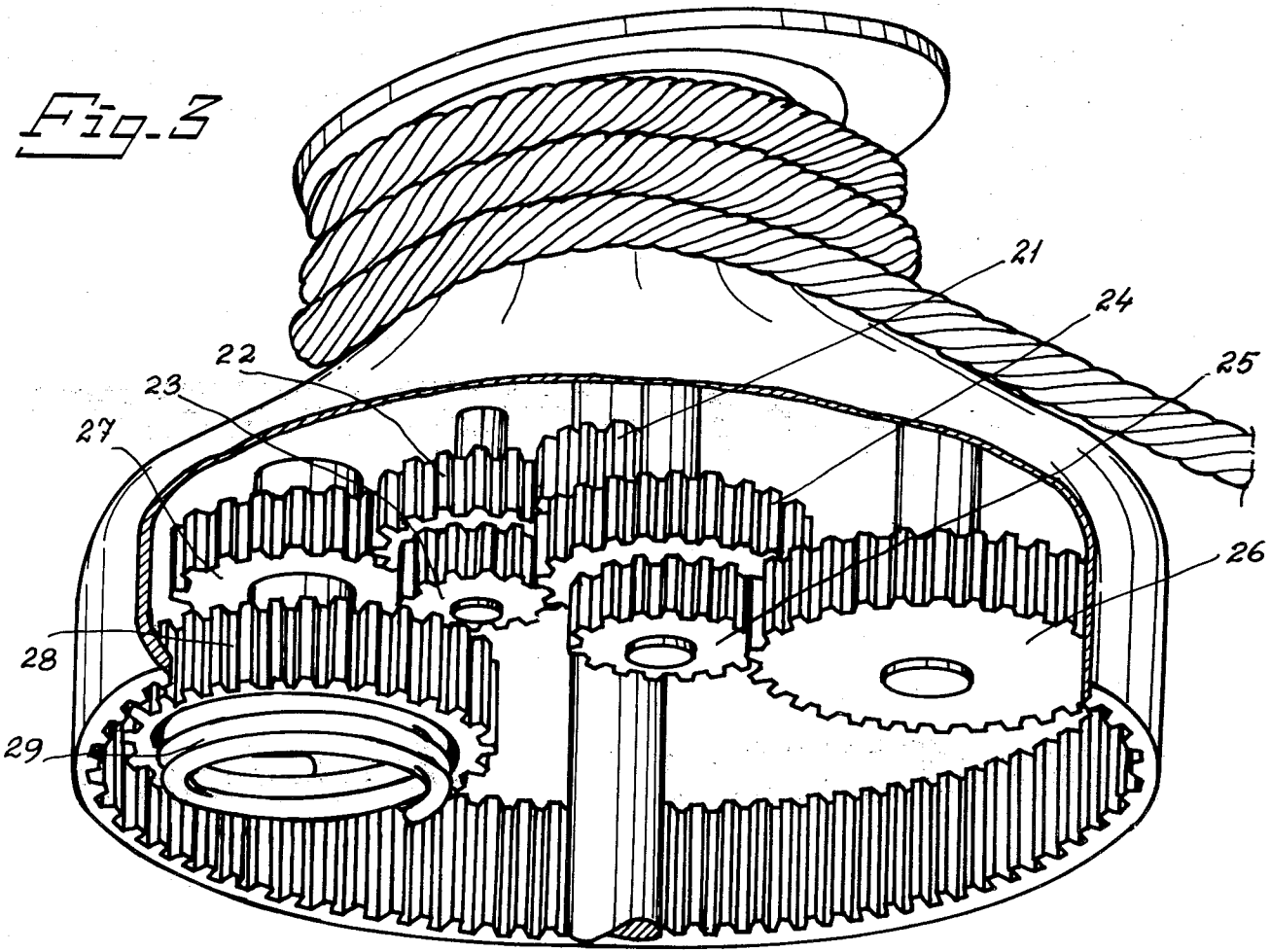
FIG. 3 is a view showing a gear box inside the winch.

A second embodiment of the invention is shown in FIGS. 2 and 3. Parts in FIGS. 2 and 3 which correspond to those shown in FIG. 1 have been given the same numerals. In FIGS. 2 and 3 there is shown the gear box which is shown by 2' but it is operated in the same way as is assumed concerning the embodiment of FIG. 1. The gear box thus transmits the rotating action from shaft 2 to the drum 3. In FIG. 2 this gear box is schematically shown at inner side of the drum 3, near its under edge which has teeth which mesh with stationary gears, the last of which meshes with the gear on the shaft 2. The gears are only shown schematically in FIG. 2 but can be seen more in detail in FIG. 3. However, since the gear box does not form a part of this invention only the following limited explanation is provided. The rotating action is transmitted from gear 21 to gear 22, to gear 27 and to gear 28 via a spring coupling 29. The gear 28 meshes with a gear ring 3' placed on the inner side of the drum 3. Moreover, a transmission with the same gear is performed from the gear 21 to the gear 22, which is fixed on the same shaft as the gear 23, which rotates the gear 24, which is fixed on the same axis as the gear 25, which drives the gear 26, which is interlocking with the gear ring 3' on the inner side of the drum 3. A rotation opposite the one explained above will loosen the spring coupling 29, whereby the gearing, which is completed by the gear 26 and is interlocking with the gear ring in the drum, will operate and this gives a different gear ratio. However, as stated above, this form of gear box, employed with winches is known.

From FIG. 2 it can be seen that the flange body 6 is inclined in relation to the shaft 2 and this is obvious from the angle between the two rotating axis 9 and 10. On the under side of the flange body 6 the annular surface 14 takes, in this embodiment, the form of a ring, which is suspended on balls 30, whereby the ring is free to run in a circular path in relation to the flange body 6. Hereby the rotating axis of the flange body 6 may be coupled to the rotating shaft 2, whereby the flange body 6 will oscillate up and down, when being rotated and the rotation will occur around the rotating axis 10. Thus, in this embodiment, there will be no rotating axis 9 as in the previously described embodiment. Note thus, that the annular surface 14 can run freely in relation to the flange body 6. It shall also be noted, that it is not necessary to use a closed circular surface 14, but the surface may consist of a part of an annular ring. If so, one must make sure that this annular part will abut the highest turn of the rope, which is wound on the drum 3. It is also possible to arrange the annular surface 14 on spots, which are fixed to a hub which has its center in the rotating axis 9 and which hub is rotated around this axis.

From FIG. 2 it can also be seen that a wheel 32 is placed within the drum at its bottom end. This wheel is fixed on the axis 2. A rope 33 is passed around the wheel and the rope is passed into the base and out of the base through two holes, not shown. Instead of using a common handle to operate the winch, one can hereby use the rope 33 in rotating the drum. Tests have shown that by using a rope, which is endless, and of a length of 80 cm, it is possible to rotate the axis 2 twice as fast as by using a handle in the conventional manner. It should be noted, that the gear box is also operational when rotating by means of the wheel 32.

It should be noted that the explained and shown embodiments of the invention only are examples of the invention. Thus, the flange body 6 may be formed in different ways and the bearings for the flange body may be of different types than the shown. The inventive idea is that there is a small part of an annular surface, which always lies closer to the drum than the remaining parts of the annular surface 14.

We claim:

1. A self-tailing winch for winding a coil of rope having a load bearing end and a free end wherein the free end is releasably clamped, comprising:

a base;

a shaft rotatably mounted on and perpendicular to said base;

a drum rotatably supported by said shaft and mounted coaxially therewith;

a flange body rotatably supported by said shaft partially within an upper portion of said drum and rotating simultaneously with said drum, said flange body having a rotational axis inclined at an angle with respect to the longitudinal axis of said shaft and forming an annular and substantially planar surface facing said base such that a portion of said annular surface is always closer to said base than the remainder of said annular surface.

2. The self-tailing winch according to claim 1, wherein a gearing means is provided to cause said drum and said flange to rotate at approximately the same speed.

3. The self-tailing winch according to claim 1, wherein said angle is approximately 8°.

4. The self-tailing winch according to claim 1, wherein said flange body has an annular groove located in its periphery.

5. The self-tailing winch according to claim 1, wherein a gear means engages said shaft and said drum.

6. The self-tailing winch according to claim 5, wherein said shaft is provided with a pulley and endless rope.

7. The self-tailing winch according to claim 5, wherein said drum releasably engages said gear means.

* * * * *